US008790143B2

(12) United States Patent
Yang et al.

(10) Patent No.: US 8,790,143 B2
(45) Date of Patent: Jul. 29, 2014

(54) ELECTRICAL RECEPTACLE TERMINAL

(75) Inventors: Yuchen Yang, Shanghai (CN); Andre E. Guanco, Royal Oak, IN (US)

(73) Assignee: Tyco Electronics (Shanghai) Co. Ltd., Shanghai (CN)

( * ) Notice: Subject to any disclaimer, the term of this patent is extended or adjusted under 35 U.S.C. 154(b) by 23 days.

(21) Appl. No.: 13/513,525

(22) PCT Filed: Nov. 29, 2010

(86) PCT No.: PCT/IB2010/055464

§ 371 (c)(1),
(2), (4) Date: Aug. 10, 2012

(87) PCT Pub. No.: WO2011/067705

PCT Pub. Date: Jun. 9, 2011

(65) Prior Publication Data

US 2012/0309240 A1 Dec. 6, 2012

(30) Foreign Application Priority Data

Dec. 3, 2009 (CN) ..... 2009 1 0258033

(51) Int. Cl.
*H01R 11/22* (2006.01)

(52) U.S. Cl.
USPC ..... 439/852

(58) Field of Classification Search
USPC ..... 439/851–858, 843–845
See application file for complete search history.

(56) References Cited

U.S. PATENT DOCUMENTS 5,551,897 A * 9/1996 Alwine ..... 439/850
5,611,717 A 3/1997 Joly
5,685,746 A * 11/1997 Maejima ..... 439/845
5,971,816 A * 10/1999 Chaillot ..... 439/852
5,989,078 A * 11/1999 Chaillot et al. ..... 439/851
6,010,377 A * 1/2000 Dechelette et al. ..... 439/851
6,152,787 A * 11/2000 Serbin et al. ..... 439/852
6,203,385 B1 * 3/2001 Sato et al. ..... 439/852
6,283,803 B1 * 9/2001 Sato et al. ..... 439/852
6,450,843 B1 * 9/2002 Heimuller ..... 439/852
6,579,132 B2 * 6/2003 Sato et al. ..... 439/852

(Continued)

OTHER PUBLICATIONS

International Preliminary Report on Patentability issued by the International Bureau of WIPO, Geneva, Switzerland, dated Jun. 5, 2012, for related International Application No. PCT/IB2010/055464; 5 pages.

(Continued)

*Primary Examiner* — Ross Gushi
(74) *Attorney, Agent, or Firm* — Faegre Baker Daniels LLP

(57) ABSTRACT

The present invention discloses an electrical receptacle terminal, comprising a contact portion being in electrical connection with a male terminal and a connecting portion being in electrical connection with an electrical cable, wherein the contact portion comprises: an housing having a bottom wall, a right wall, a left wall and a top wall; and an elastic contact member located in the housing and connected to the top wall of the housing through a suspension member. According to the present invention, the elastic contact member is suspended on the top wall of the housing through a suspension member. Since the suspension member that is connected to the elastic contact member itself exhibits certain flexibility, the elastic contact member and the male terminal inserted into the elastic contact member can do slight motion along with the suspension member in the front-rear direction. Thus, there is no relative slight motion between the elastic contact member and the male terminal inserted into the elastic contact member.

18 Claims, 6 Drawing Sheets

(56) References Cited

U.S. PATENT DOCUMENTS

| | | | | |
|---|---|---|---|---|
| 6,860,768 | B2 * | 3/2005 | Zhao | 439/852 |
| 7,223,134 | B2 * | 5/2007 | Chaillot | 439/851 |
| 7,896,678 | B2 * | 3/2011 | Zhang | 439/342 |
| 2002/0160666 | A1 * | 10/2002 | Sato et al. | 439/852 |
| 2004/0014370 | A1 * | 1/2004 | Zhao | 439/843 |
| 2012/0309240 | A1 * | 12/2012 | Yang et al. | 439/843 |

OTHER PUBLICATIONS

International Search Report and Written Opinion issued by the European Patent Office, dated Mar. 4, 2011, for related International Application No. PCT/IB2010/055464; 9 pages.

* cited by examiner

ELECTRICAL RECEPTACLE TERMINAL

CROSS-REFERENCE TO RELATED APPLICATION

This application claims the benefit of Chinese Patent Application No. 200910258033.5 filed on Dec. 3, 2009 in the State Intellectual Property Office of China, the disclosure of which is incorporated herein by reference.

BACKGROUND OF THE INVENTION

1. Field of the Invention

The present invention relates to a field of electric connection, and in particular, to an electrical receptacle terminal.

2. Description of the Related Art

It has been known that the existing electrical receptacle terminal generally comprises a contact portion and a connecting portion. The connecting portion 200 is in electrical connection with an electrical cable by splicing, and the contact portion is in electrical connection with an inserted male terminal through an elastic contact piece. Usually, the existing electrical receptacle terminal adopts an integrated design. The electrical receptacle terminal is generally rigidly connected to the elastic contact piece. Once an electrical cable is inserted into the electrical receptacle terminal, the latter has an increased mass and is restrained by the electrical cable. As a result the electrical receptacle terminal can not do a forward and backward movement easily. Thus, once the electrical receptacle terminal is used in a strong jolting environment (for example, in a vehicle), there is high likelihood that a slightly motion for the male terminal inserted into the elastic contact piece relative to the electrical receptacle terminal may occur. After a long period in which the motion occurs has lapsed, the surface (usually coated with tin thereon) of the electrical receptacle terminal will be scrapped to form a non-conductive oxide layer so as to disable the electric connection of the electrical receptacle terminal. This phenomenon is called as fretting corrosion.

As shown in FIGS. 1 and 2, aiming to effectively overcome fretting corrosion, U.S. Pat. No. 5,611,717 discloses a miniature anti-fretting receptacle terminal. The receptacle terminal comprises a connecting portion 8, a contact portion 14, and a spring portion 12 located between the connecting portion 8 and the contact portion 14. The spring portion 12 comprises two pairs of U-shaped elastic portions 22, 24 located on the side walls, respectively. Each of the elastic portions 22, 24 respectively comprises a pair of elastic beams 26, 27 and 28, 29, and, the upper portions of each pair of the elastic beams 26, 27 and 28, 29 are connected by U-shaped bridge portions 30, 32, respectively.

As shown in FIGS. 1 and 2, in the miniature anti-fretting receptacle terminal disclosed by U.S. Pat. No. 5,611,717, a spring portion 12 is provided between the connecting portion 8 and the contact portion 14 of the receptacle terminal, as such, the whole receptacle terminal is much more flexible. Therefore, this receptacle terminal itself can move in a forward and backward manner without the restriction from the inserted electrical cable. Thus, when the receptacle terminal is used in a strong jolting environment (for example, in a vehicle), there is no slightly motion for the male terminal inserted into the elastic contact piece 50 relative to the electrical receptacle terminal, instead, it moves together with the spring portion 12 of the electrical receptacle terminal, so as to effectively eliminate fretting corrosion problem.

However, according to the disclosure of U.S. Pat. No. 5,611,717, a spring portion is provided between the connecting portion and the contact portion of the receptacle terminal. The receptacle terminal requires more materials and has a more complicated structure. Hence, the cost is relatively high. Furthermore, the connecting terminal and the spring portion of this receptacle terminal are exposed to the environment, and may be easily damaged or even broken off.

In order to overcome or alleviate at least one aspect of the above mentioned technical problems, it is necessary in the art to provide a novel electrical receptacle terminal with simple structure and low cost which has the advantages of eliminating fretting corrosion problem and diminishing the impact from external force.

SUMMARY OF THE INVENTION

Accordingly, at least one aspect of the present invention is to provide an electrical receptacle terminal, which comprises a contact portion adapted for being in electrical connection with a male terminal and a connecting portion adapted for being in electrical connection with an electrical cable. The contact portion comprises: a housing having a bottom wall, a right wall, a left wall and a top wall; and an elastic contact member located in the housing and connected to the top wall of the housing through a suspension member.

In one preferred embodiment of the present invention, the cross-section of the housing is one of square, rectangular, and circular. It should be noted that the present invention is not limited to this. Alternatively, there are various other closed structures for the cross-section of the housing.

In another preferred embodiment of the present invention, the elastic contact member comprises a left-half elastic part and a right-half elastic piece.

In still another preferred embodiment of the present invention, the suspension member is connected to one of an base portion of the right-half elastic part and that of the left-half elastic piece.

In yet another preferred embodiment of the present invention, the left wall has a left wall opening and a left subsidiary elastic part located in the left wall opening, wherein one end of the left subsidiary elastic part is connected to an side edge of the left wall opening, and, the other end of the left subsidiary elastic part is curved inwardly in the housing and elastically abutted against an outer wall of the left-half elastic part of the elastic contact member; and the right wall has a right wall opening and a right subsidiary elastic part located in the right wall opening, wherein one end of the right subsidiary elastic part is connected to an side edge of the right wall opening, and, the other end of the right subsidiary elastic part is curved inwardly in the housing and elastically abutted against an outer wall of the right-half elastic part of the elastic contact member.

In another preferred embodiment of the present invention, the connecting portion comprises: a first U-shaped connecting member having first lateral flanks provided at both sides thereof and being able to crimp, so as to crimp thereinside the sheath of the electrical cable; and a second U-shaped connecting member having one end extended from the first U-shaped connecting member and the other end extending to the contact portion of the housing, wherein the second U-shaped connecting member having second lateral flanks provided at both sides thereof and being able to crimp up inwardly, so as to crimp thereinside the stripped part of the electrical cable.

In yet another preferred embodiment of the present invention, the top wall comprises a right-half top wall part and a left-half top wall part, wherein the right-half top wall part and the left-half top wall part are joined with each other so as to form the top wall.

In again another preferred embodiment of the present invention, the electrical receptacle terminal is formed by folding a single metal sheet by press molding.

In another preferred embodiment of the present invention, the right-half elastic part and the left-half elastic part of the elastic contact member are provided at one same side of the sheet when the electrical receptacle terminal is unfolded.

As apparent from the above different embodiments of the present invention, the elastic contact member is suspended on the top wall of the housing through a suspension member. Since the suspension member connected to the elastic contact member itself exhibits certain flexibility, the elastic contact member and the male terminal inserted into the elastic contact member can do slight motion along with the suspension member in the front-rear direction. Thus, there is no relative slight motion between the elastic contact member and the male terminal inserted into the elastic contact member, so as to effectively solve fretting corrosion problem. Also, while solving the fretting corrosion problem, the present invention has simple structure and low cost by adopting a flexible suspension member.

DETAILED DESCRIPTION OF PREFERRED EMBODIMENTS OF THE INVENTION

Figure 1:
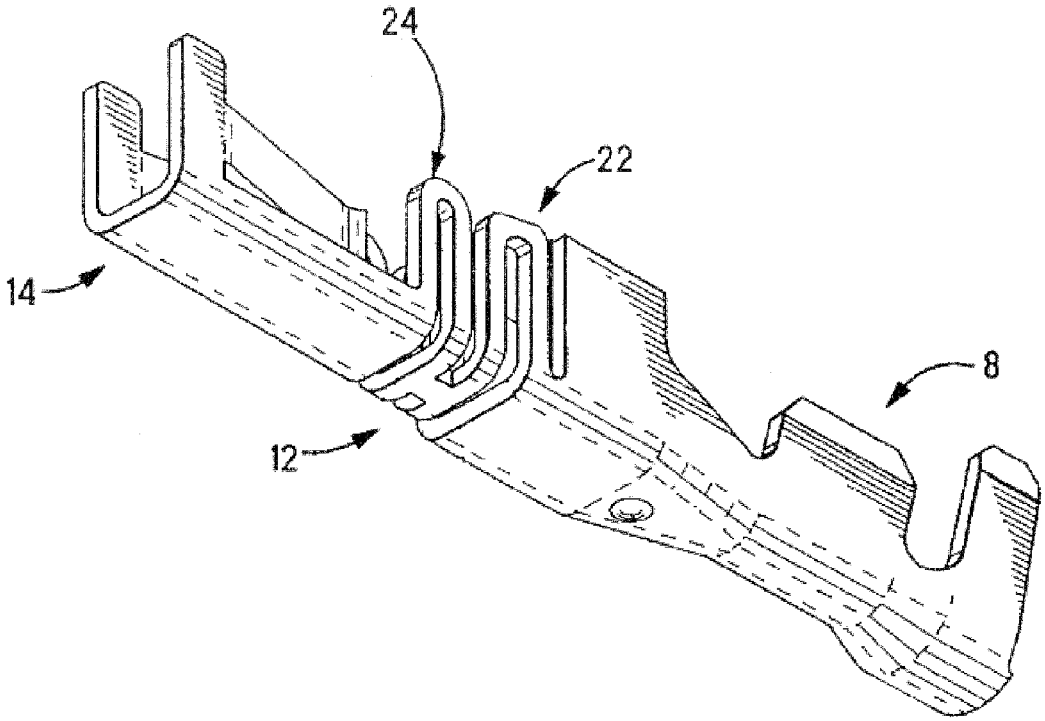
FIGS. 1 and 2 are schematic perspective views which illustrates an electrical receptacle terminal in the prior art.
Figure 2:
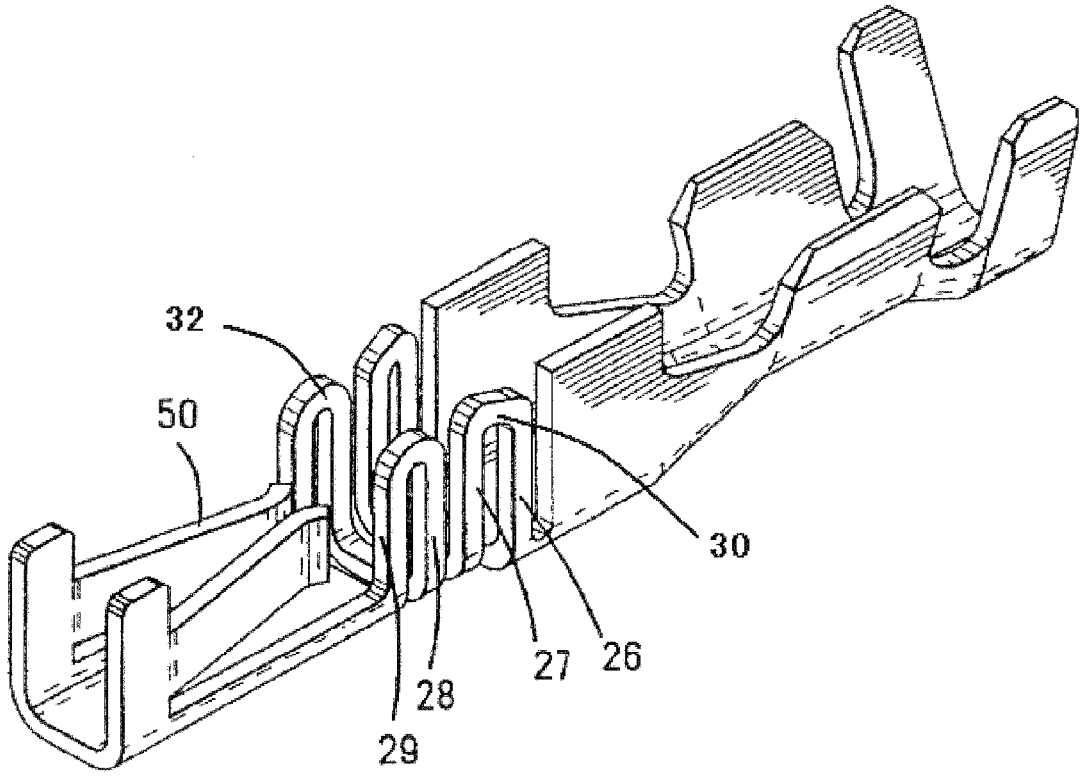

Exemplary embodiments of the present disclosure will be described hereinafter in detail with reference to the attached drawings, wherein the like reference numerals refer to the like elements. The present disclosure, however, should not be construed as being limited to the embodiment set forth herein; rather, these embodiments are provided so that the present disclosure will be thorough and complete, and will fully convey the concept of the disclosure to those skilled in the art.

First Embodiment

Figure 3:
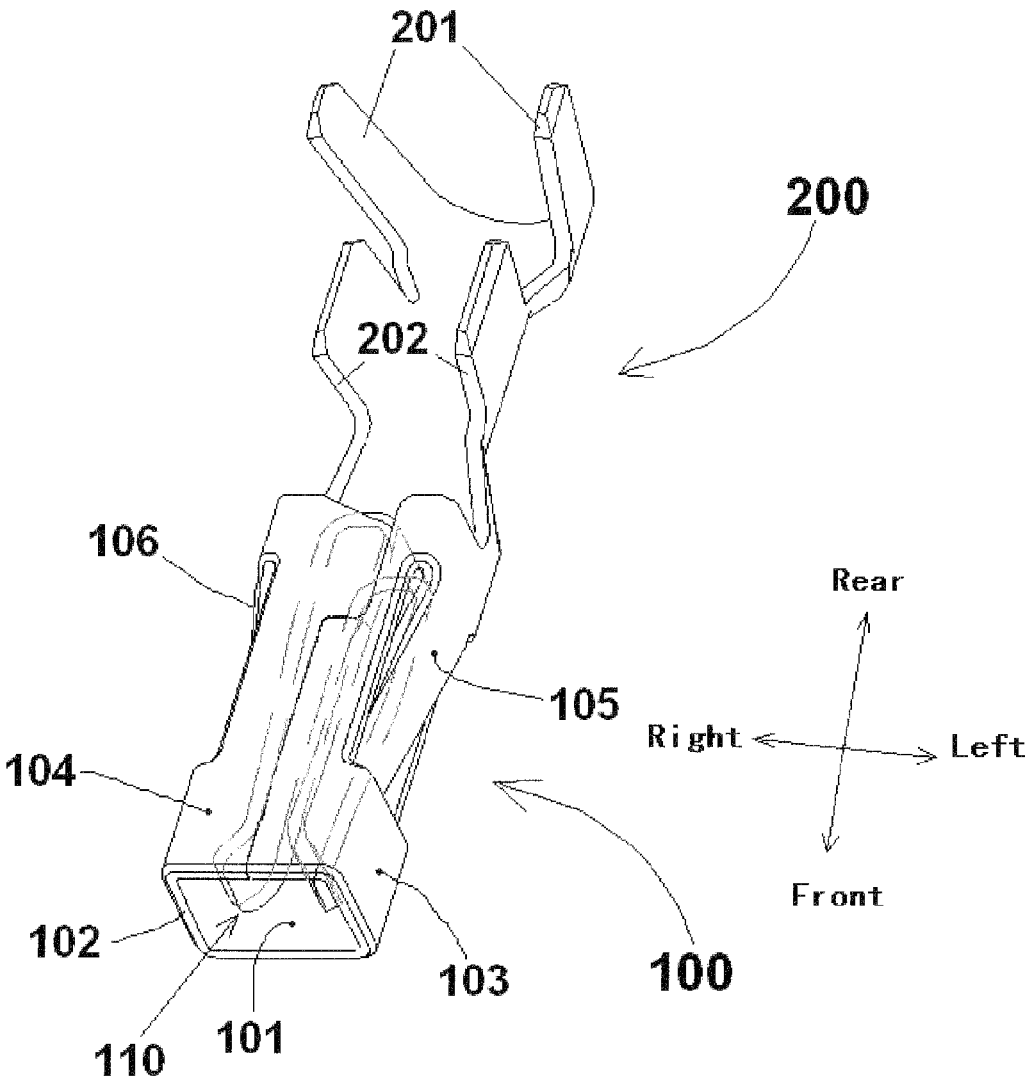
FIG. 3 is a schematic perspective view showing an electrical receptacle terminal according to the first embodiment of the present invention.
Figure 4:
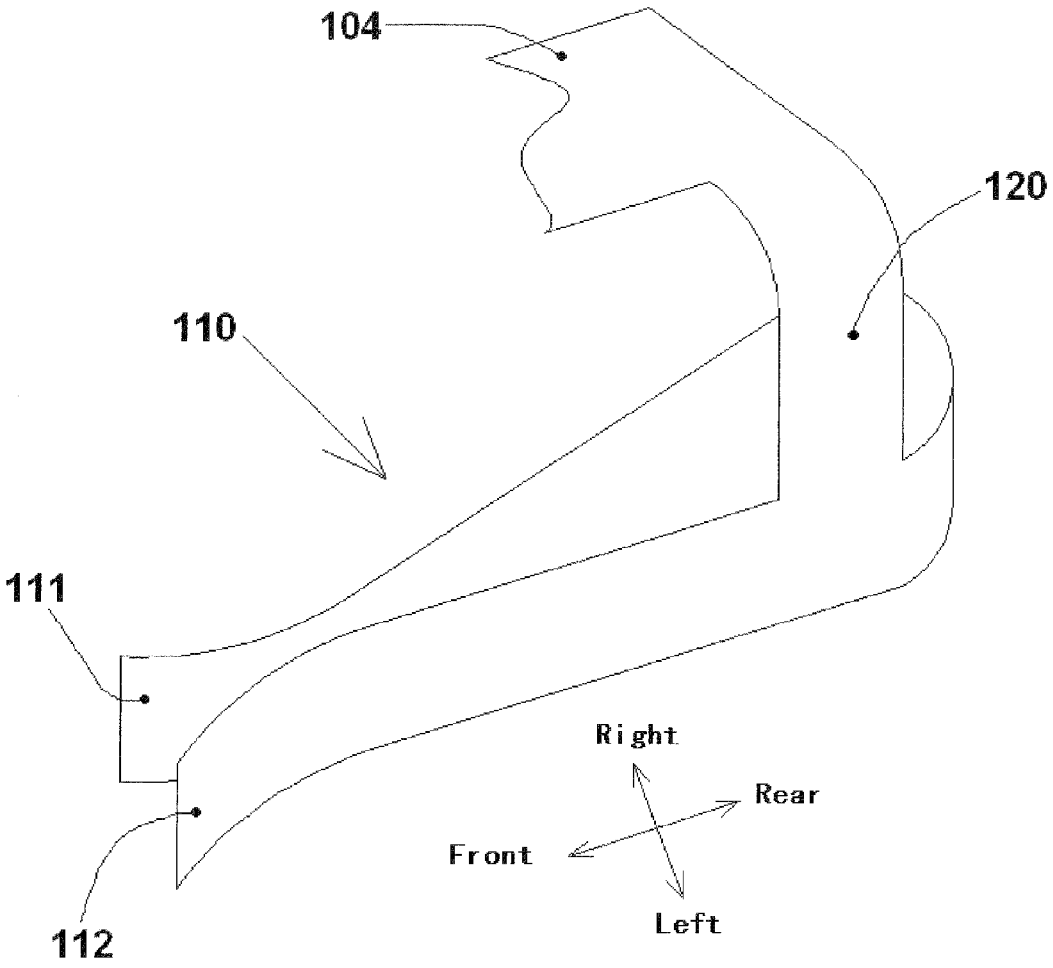
FIG. 4 is a schematic partial view showing the electrical receptacle terminal of FIG. 3, illustrating that an elastic contact member is suspended in the housing through a suspension member.
Figure 5:
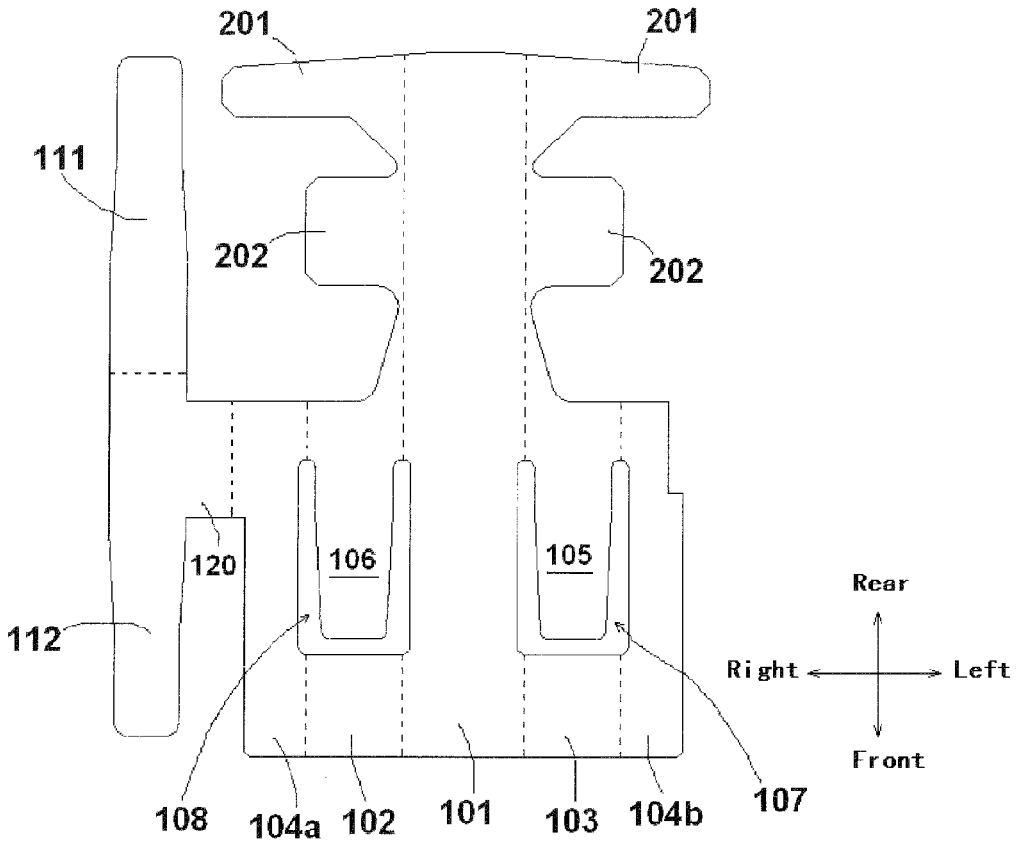
FIG. 5 is schematic view showing the unfolded electrical receptacle terminal of FIG. 3.

FIGS. 3-5 show an electrical receptacle terminal according to a first embodiment of the present invention. Particularly, FIG. 3 is a schematic perspective view showing an electrical receptacle terminal according to the first embodiment of the present invention; FIG. 4 is a schematic partial view showing the electrical receptacle terminal of FIG. 3, illustrating that an elastic contact member is suspended in the housing through a suspension member; and, FIG. 5 is schematic view showing the unfolded electrical receptacle terminal of FIG. 3.

As shown in FIG. 3, FIG. 4 and FIG. 5, according to the preferred embodiment of the present invention, for purpose of clarity, a rectangular coordinate system is provided, in which the front-rear direction denotes the longitudinal direction of the electrical receptacle terminal and the left-right direction denotes the transverse direction of the electrical receptacle terminal.

As shown in FIG. 3, FIG. 4 and FIG. 5, according to the present invention, the electrical receptacle terminal mainly comprises a contact portion 100 and a connecting portion 200. The contact portion 100 is adapted for being in electrical connection with a male terminal (a contact pin generally, not shown), and the connecting portion 200 is adapted for being in electrical connection with an electrical cable.

As shown in FIG. 3, the contact portion 100 comprises a housing and an elastic contact member 110 located in the housing. In the preferred embodiment, the housing is embodied as an annular housing and has a bottom wall 101, a right wall 102, a left wall 103 and a top wall 104. Such annular housing provides sufficient protection for the elastic contact member 110.

As shown in FIG. 3 and FIG. 4, the elastic contact member 110 is connected to the top wall 104 of the housing through a suspension member 120, so as to suspend the elastic contact member 110 within the housing. According to the present invention, since the suspension member 120 connected to the elastic contact member 110 itself exhibits certain flexibility, the elastic contact member 110 and the male terminal inserted into the elastic contact member 110 can do slight motion along with the suspension member 120 in the front-rear direction. Thus, there is no relative slight motion between the elastic contact member 110 and the male terminal inserted into the elastic contact member 110, so as to effectively solve fretting corrosion problem. Also, it has simple structure and low cost.

As shown in FIG. 3, according to the present invention, the housing has a cross-section of quadratic form, for example, it is square or rectangular. The housing of the present invention, however, is not limited to the structure set forth herein, rather, the cross-section of the housing may be circular or any suitable shape.

As shown in FIG. 4, according to one preferred embodiment of the present invention, the elastic contact member 110 further comprises a left-half elastic part 112 and a right-half elastic part 111. The elastic contact member 110 has a broaden base portion and a narrow inserting opening portion, which functions as an elastic clamp which is capable of reliably clamping the inserted male terminal.

As shown in FIG. 4, according to one preferred embodiment of the present invention, the suspension member 120 is connected to the base portion of the left-half elastic part 112. It should be mentioned that, however, the suspension member 120 also may be connected to the base portion of the right-half elastic part 111.

As shown in FIG. 3 and FIG. 5, according to one preferred embodiment of the present invention, the left wall 103 has a left wall opening 107 and a left subsidiary elastic part 105 located in the left wall opening 107. The rear end of the left subsidiary elastic part 105 is connected to the rear side edge of the left wall opening 107, and, the front end of the left subsidiary elastic part 105 is a free end, which is curved inwardly in the housing and elastically abutted against an outer wall of the left-half elastic part 112 of the elastic contact member.

Similarly, the right wall 102 has a right wall opening 108 and a right subsidiary elastic part 106 located in the right wall opening 108. The rear end of the right subsidiary elastic part 106 is connected to the rear side edge of the right wall opening 108, and, the front end of the right subsidiary elastic part 106 is a free end, which is curved inwardly in the housing and elastically abutted against an outer wall of the right-half elastic part 111 of the elastic contact member.

Thus, the contact strength between the elastic contact member 110 and the mating male terminal is enhanced by providing a pair of subsidiary elastic pieces 105, 106 on the left wall 103 and the right wall 102 of the housing.

As shown in FIG. 3 and FIG. 5, according to one preferred embodiment of the present invention, the connecting portion 200 comprises a first U-shaped connecting member 201. In the preferred embodiment, a first U-shaped connecting member 201 has a pair of first lateral flanks provided at both sides thereof When in use, the pair of first lateral flanks is able to crimp up inwardly, so that a sheath of the electrical cable is to be crimped therebetween to firmly hold the electrical cable.

As shown in FIG. 3 and FIG. 5, according to one preferred embodiment of the present invention, the connecting portion 200 further comprises a second U-shaped connecting member 202. The second U-shaped connecting member 202 has a rear end connectable to the first U-shaped connecting member 201 and a front end connectable to the housing of the contact portion 100. Further, similarly, the second U-shaped connecting member 202 has a pair of second lateral flanks provided at both sides thereof When in use, the pair of second lateral flanks is able to crimp up inwardly, so that a stripped inner core of the electrical cable is to be crimped therebetween to firmly hold the electrical cable.

As shown in FIG. 5, according to one preferred embodiment of the present invention, the whole electrical receptacle terminal is formed by folding a whole metal sheet as shown in FIG. 5. The elastic contact member of FIG. 3 is formed by folding the metal sheet along these broken lines in FIG. 5 the broken lines in FIG. 5 denote foldable lines.

As shown in FIG. 3 and FIG. 5, since the whole elastic contact member is formed by folding a single piece of metal sheet, the top wall 104 actually comprises a right-half top wall part 104*a* and a left-half top wall part 104*b*. The right-half top wall part 104*a* and the left-half top wall part 104*b* are joined with each other so as to form the top wall 104.

According to one preferred embodiment of the present invention, the electrical receptacle terminal of FIG. 3 is formed by folding a single metal sheet of FIG. 5 by press molding.

As shown in FIG. 5, according to one preferred embodiment of the present invention, when the electrical receptacle terminal of FIG. 3 is unfolded into a sheet of FIG. 5, the right-half elastic part 111 and the left-half elastic part 112 of the elastic contact member 110 are provided at one same side of the sheet, i.e. both at the right side of the sheet.

Second Embodiment

Figure 6:
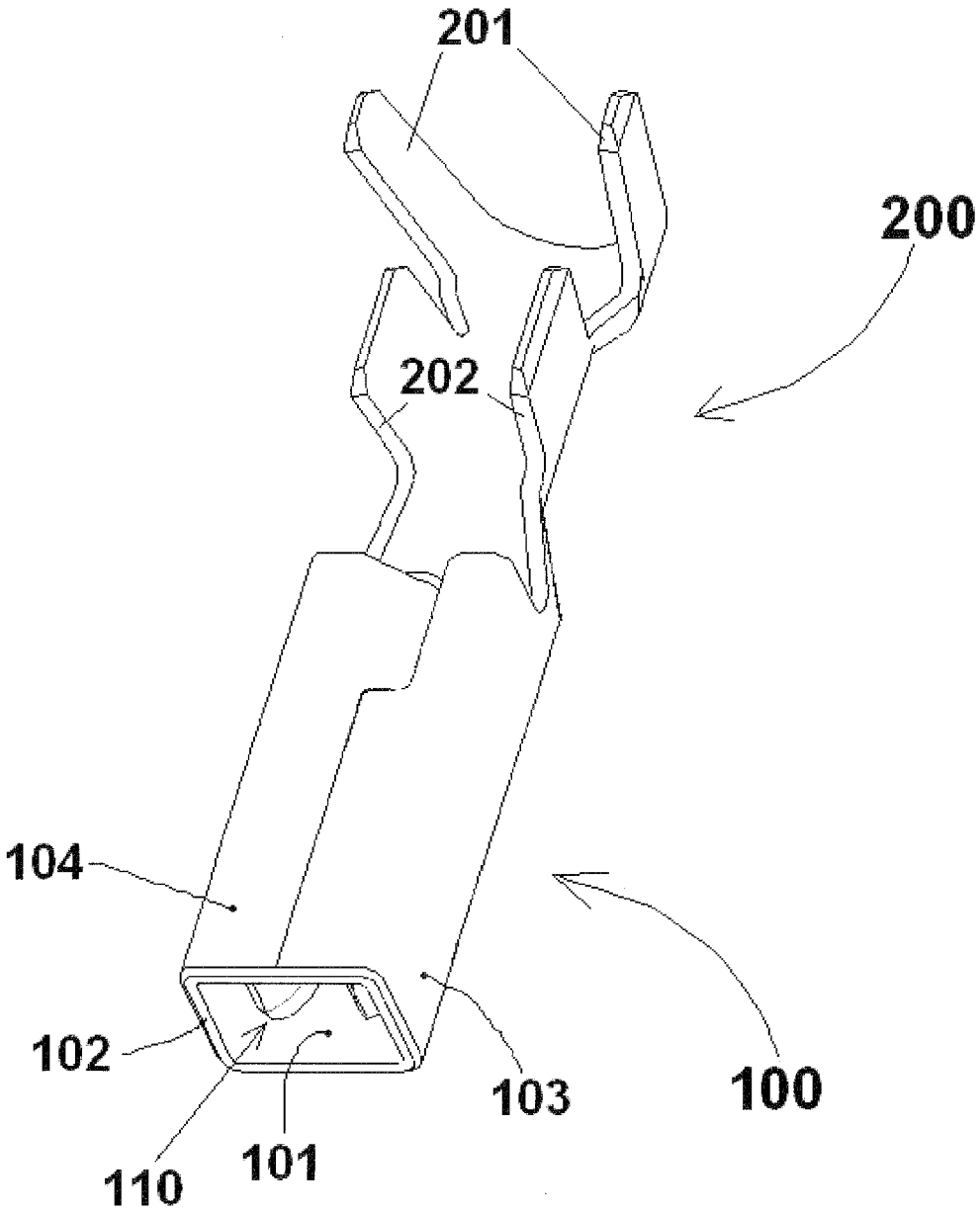
FIG. 6 is a schematic perspective view showing an electrical receptacle terminal according to the second embodiment of the present invention.

FIG. 6 shows an electrical receptacle terminal according to a second embodiment of the present invention. Particularly, FIG. 6 is a schematic perspective view showing an electrical receptacle terminal according to the second embodiment of the present invention.

Compared with the electrical receptacle terminal according to the first embodiment, the electrical receptacle terminal according to the second embodiment is different in that: the left subsidiary elastic part 105 and the right subsidiary elastic part 106 respectively on the left wall 103 and the right wall 104 of the electrical receptacle terminal in the first embodiment are removed, meanwhile, the left wall opening 107 and the right wall opening 108 respectively on the left wall 103 and the right wall 104 of the electrical receptacle terminal in the first embodiment are removed, correspondingly.

Although several exemplary embodiments have been shown and described, it would be appreciated by those skilled in the art that various changes or modifications may be made in these embodiments without departing from the principles and spirit of the disclosure, the scope of which is defined in the claims and their equivalents.

What is claimed is:

1. An electrical receptacle terminal, comprising a contact portion adapted for being in electrical connection with a male terminal and a connecting portion adapted for being in electrical connection with an electrical cable, the contact portion comprising:

a housing having a bottom wall, a right wall, a left wall and a top wall, wherein the top wall comprises a right-half top wall part and a left-half top wall part; and the right-half top wall part and the left-half top wall part are joined with each other so as to form the top wall; and an elastic contact member located in the housing and connected to the top wall of the housing through a suspension member, the elastic contact member comprising right-half and left-half elastic parts, which have front end portions spaced from each other in a lateral direction of the electrical receptacle terminal.

2. The electrical receptacle terminal according to claim 1, wherein the cross-section of the housing is square, rectangular, or circular.

3. The electrical receptacle terminal according to claim 1, wherein the right-half top wall part and the left-half top wall part extend from the right wall and the left wall, respectively, when the electrical receptacle terminal is unfolded.

4. The electrical receptacle terminal according to claim 1, wherein the right-half elastic part and the left-half elastic part each have a base portion; and the suspension member is connected to one of the base portions of the right-half elastic part and the left-half elastic part.

5. The electrical receptacle terminal according to claim 1, wherein:

the left wall has a left wall opening and a left subsidiary elastic part located in the left wall opening, wherein one end of the left subsidiary elastic part is connected to an side edge of the left wall opening, and, the other end of the left subsidiary elastic part is curved inwardly in the housing and elastically abutted against an outer wall of the left-half elastic part of the elastic contact member; and the right wall has a right wall opening and a right subsidiary elastic part located in the right wall opening, wherein one end of the right subsidiary elastic part is connected to an side edge of the right wall opening, and, the other end of the right subsidiary elastic part is curved inwardly in the housing and elastically abutted against an outer wall of the right-half elastic part of the elastic contact member.

6. The electrical receptacle terminal according to claim 1, wherein the connecting portion comprises:

a first connecting member having first lateral flanks provided at both sides thereof and being able to crimp, so as to crimp thereinside the sheath of the electrical cable; and a second connecting member having one end extended from the first connecting member and the other end extending to the housing of the contact portion, wherein the second connecting member having second lateral flanks provided at both sides thereof and being able to crimp, so as to crimp thereinside the stripped part of the electrical cable.

7. The electrical receptacle terminal according to claim 1, wherein the electrical receptacle terminal is formed by folding a single stamped metal sheet.

8. The electrical receptacle terminal according to claim 7, wherein the right-half elastic part and the left-half elastic part of the elastic contact member are provided at one same side of the metal sheet and extend from the suspension member in opposite directions, when the electrical receptacle terminal is unfolded.

9. The electrical receptacle terminal according to claim 7, wherein the right-half elastic part and the left-half elastic part of the elastic contact member are aligned with each other in a longitudinal direction of the electrical receptacle terminal, when the electrical receptacle terminal is unfolded.

10. An electrical receptacle terminal, comprising a contact portion adapted for being in electrical connection with a male terminal and a connecting portion adapted for being in electrical connection with an electrical cable, the contact portion comprising:

a housing having a bottom wall, a right wall, a left wall and a top wall; and an elastic contact member located in the housing and connected to the top wall of the housing through a suspension member, the elastic contact member comprising right-half and left-half elastic parts, which have front end portions spaced from each other in a lateral direction of the electrical receptacle terminal, wherein the right-half elastic part and the left-half elastic part of the elastic contact member are aligned with each other in a longitudinal direction of the electrical receptacle terminal, when the electrical receptacle terminal is unfolded.

11. The electrical receptacle terminal according to claim 10, wherein the cross-section of the housing is square, rectangular, or circular.

12. The electrical receptacle terminal according to claim 10, wherein the top wall comprises a right-half top wall part and a left-half top wall part; and the right-half top wall part and the left-half top wall part are joined with each other so as to form the top wall.

13. The electrical receptacle terminal according to claim 12, wherein the right-half top wall part and the left-half top wall part extend from the right wall and the left wall, respectively, when the electrical receptacle terminal is unfolded.

14. The electrical receptacle terminal according to claim 10, wherein the right-half elastic part and the left-half elastic part each have a base portion; and the suspension member is connected to one of the base portions of the right-half elastic part and the left-half elastic part.

15. The electrical receptacle terminal according to claim 10, wherein:

the left wall has a left wall opening and a left subsidiary elastic part located in the left wall opening, wherein one end of the left subsidiary elastic part is connected to an side edge of the left wall opening, and, the other end of the left subsidiary elastic part is curved inwardly in the housing and elastically abutted against an outer wall of the left-half elastic part of the elastic contact member; and the right wall has a right wall opening and a right subsidiary elastic part located in the right wall opening, wherein one end of the right subsidiary elastic part is connected to an side edge of the right wall opening, and, the other end of the right subsidiary elastic part is curved inwardly in the housing and elastically abutted against an outer wall of the right-half elastic part of the elastic contact member.

16. The electrical receptacle terminal according to claim 10, wherein the connecting portion comprises:

a first connecting member having first lateral flanks provided at both sides thereof and being able to crimp, so as to crimp thereinside the sheath of the electrical cable; and a second connecting member having one end extended from the first connecting member and the other end extending to the housing of the contact portion, wherein the second connecting member having second lateral flanks provided at both sides thereof and being able to crimp, so as to crimp thereinside the stripped part of the electrical cable.

17. The electrical receptacle terminal according to claim 10, wherein the electrical receptacle terminal is formed by folding a single stamped metal sheet.

18. The electrical receptacle terminal according to claim 17, wherein the right-half elastic part and the left-half elastic part of the elastic contact member are provided at one same side of the metal sheet and extend from the suspension member in opposite directions, when the electrical receptacle terminal is unfolded.

* * * * *